US009267320B2

(12) United States Patent
Kitterman

(10) Patent No.: US 9,267,320 B2
(45) **Date of Patent: *Feb. 23, 2016**

(54) PANELLESS SHUTTER

(76) Inventor: Mark Kitterman, Gilbert, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/460,326

(22) Filed: Apr. 30, 2012

(65) Prior Publication Data

US 2012/0233924 A1 Sep. 20, 2012

Related U.S. Application Data

(63) Continuation of application No. 12/424,469, filed on Apr. 15, 2009, now Pat. No. 8,201,609, which is a continuation-in-part of application No. 10/965,469, filed on Oct. 13, 2004, now abandoned.

(51) Int. Cl.

| | |
|---|---|
| ***E05D 15/00*** | (2006.01) |
| ***E05F 17/00*** | (2006.01) |
| ***E06B 7/096*** | (2006.01) |

(Continued)

(52) U.S. Cl.

CPC ..... *E05F 17/00* (2013.01); *E05D 15/582* (2013.01); *E05F 17/004* (2013.01); *E06B 7/096* (2013.01); *E06B 9/0638* (2013.01);

(Continued)

(58) Field of Classification Search

CPC ..... E06B 9/386; E06B 9/30; E06B 7/084; E06B 9/302

USPC ..... 160/166.1, 174 R, 175, 176.1 R, 177 R, 160/178.1 R, 34, 167 R, 172 R, 168.1 R, 160/173 R; 49/74.1, 82.1, 87.1

See application file for complete search history.

(56) References Cited

U.S. PATENT DOCUMENTS 1,708,636 A * 4/1929 Shook ..... 160/150
1,723,095 A * 8/1929 Tate ..... 160/172 R (Continued)

FOREIGN PATENT DOCUMENTS

EP 2351902 A2 3/2011

OTHER PUBLICATIONS

Andy Lin, "Paper Clip Your Blinds Open for Better Lighting (Without Sacrificing Privacy)", Feb. 10, 2011; [retrieved from the internet, Mar. 3, 2014: http://lifehacker.com/5757330/paper-clip-your-blinds-for-increased-light-without-sacrificing-privacy.

(Continued)

*Primary Examiner* — Katherine Mitchell
*Assistant Examiner* — Johnnie A Shablack
(74) *Attorney, Agent, or Firm* — Schmeiser, Olsen & Watts LLP

(57) ABSTRACT

A panelless shutter is provided, the panelless shutter including a window frame and a plurality of louvers horizontally mounted within the window frame in a parallel configuration, each louver having a first end and a second end. The panelless shutter also includes a louver mechanism comprising a plurality of rotatable members slideably retained within a track and a gear shaft operably coupled to each rotatable member, wherein the rotatable members are coupled to the first end of each louver of the plurality of louvers and the gear shaft rotates each of the plurality of louvers substantially simultaneously. The shutter further includes a louver retainer rotatably securing the second end of each louver of the plurality of louvers, the louver retainer allowing the rotation and vertical sliding of each louver.

7 Claims, 13 Drawing Sheets

(51) Int. Cl.
*E06B 9/06* (2006.01)
*E05D 15/58* (2006.01)

(52) U.S. Cl.
CPC ..... *E06B 9/0676* (2013.01); *E05Y 2900/146* (2013.01); *E05Y 2900/148* (2013.01)

(56) References Cited

U.S. PATENT DOCUMENTS 1,888,522 A * 11/1932 Ward ..... 49/86.1
2,167,840 A * 8/1939 Hepworth ..... 160/172 R
2,651,085 A * 9/1953 Kopp ..... 49/64
2,708,295 A 5/1955 Johnson
2,874,771 A 2/1959 Muhr
3,001,250 A 9/1961 Kenny
3,208,507 A * 9/1965 Breen ..... 160/168.1 V
3,690,035 A 9/1972 Schindlauer
3,717,195 A * 2/1973 Larranaga ..... 160/169
3,744,544 A * 7/1973 Wellensiek ..... 160/169
4,155,395 A 5/1979 Frei
4,313,650 A * 2/1982 Ward et al. ..... 359/596
4,449,563 A 5/1984 Toda et al.
4,616,688 A * 10/1986 Agos ..... 160/176.1 R
4,763,713 A 8/1988 Kraus
4,850,138 A 7/1989 Watanabe et al.
4,872,499 A * 10/1989 Anderson ..... 160/168.1 R
5,392,561 A 2/1995 Henley, Sr.
5,419,082 A 5/1995 Li
5,469,658 A 11/1995 Digianni et al.
5,474,117 A 12/1995 Henkenjohann
5,595,231 A 1/1997 Marocco
5,813,447 A 9/1998 Lysyj
6,041,547 A * 3/2000 Marocco ..... 49/87.1
6,061,962 A 5/2000 Sosa
6,152,205 A 11/2000 Toti
6,314,680 B1 * 11/2001 Buckwalter et al. ..... 49/82.1
6,499,255 B1 * 12/2002 Givoni ..... 49/82.1
6,536,162 B2 3/2003 LaMay
6,675,534 B2 * 1/2004 Marocco ..... 49/86.1
6,701,669 B1 3/2004 Yourgason
6,810,621 B1 11/2004 Ricci
6,953,074 B2 * 10/2005 Cardinal ..... 160/168.1 R
7,331,370 B1 2/2008 Militello et al.
7,353,636 B1 * 4/2008 Anderson et al. ..... 49/82.1
7,389,609 B2 6/2008 Yorgason
7,866,737 B2 1/2011 Browne et al.
7,896,056 B2 * 3/2011 Ben-David ..... 160/107
8,201,609 B1 * 6/2012 Kitterman ..... 160/201
8,281,518 B2 10/2012 Marocco
8,302,653 B2 11/2012 O'Hair
8,474,187 B2 7/2013 Marocco
8,528,254 B1 9/2013 Johnston
8,555,948 B2 10/2013 Park
2001/0011581 A1 * 8/2001 Welfondr ..... 160/166.1
2004/0045220 A1 * 3/2004 Fraser et al. ..... 49/74.1
2005/0005523 A1 1/2005 Johnston
2006/0225844 A1 10/2006 Gittens et al.
2007/0187048 A1 * 8/2007 Hung ..... 160/168.1 R
2007/0193702 A1 * 8/2007 Hung ..... 160/172 R
2008/0099160 A1 * 5/2008 Chen ..... 160/172 R
2009/0223149 A1 9/2009 Zalesak
2012/0097343 A1 4/2012 O'Hair

OTHER PUBLICATIONS

PCT International Search Report and Written Opinion for: PCT/US13/69925.

* cited by examiner

PANELLESS SHUTTER

CROSS REFERENCE TO RELATED APPLICATION

This application is a continuation of earlier U.S. Utility patent entitled "HINGED FACE MOUNT FRAME," Ser. No. 12/424,469, filed Apr. 15, 2009, now U.S. Pat. No. 8,201,609, which is a continuation-in-part of the earlier U.S. Utility patent entitled "HINGED FACE MOUNT FRAME," Ser. No. 10/965,469, filed Oct. 13, 2004, the disclosures of which are hereby incorporated entirely herein by reference.

BACKGROUND OF THE INVENTION

1. Technical Field

This invention relates generally to a window treatment and more particularly to a panelless shutter.

2. State of the Art

There are several types of window treatments available, most of which require some form of measuring the dimensions of a particular window and seeking a window treatment that fits the window. Windows are generally of common dimensions, with variations in those dimensions or a window that is out-of-square, for reasons such as construction error or settling of the house foundation. These slight variations are of particular concern when installing shutters, shutter blinds or like window treatments. When shutters are installed onto windows, a precise measurement must be made in order to best fit the shutter to the window. The shutters are then made to the precise measurements and installed.

In order to avoid having to make such precise measurements and the related costs, the use of a face mount frame was introduced. This enabled the variations of the window size to be accounted for and corrected by first installing a window frame that would result in the proper size of frame for the shutters to be installed, allowing the shutters to be installed onto the face mount frame. The shutters were installed without the need of precise measurements to account for the small inconsistencies in window opening dimensions.

Conventional frames are able to house conventional shutters that include panels for retaining louvers and a louver bar for rotating the louvers into an open position. Hinges are used to connect the shutter panel to the frame to provide egress or access to the window. Traditional shutter panels reduce the viewable area of the window when the louvers are rotated, reducing the amount of natural light that may enter or restricting the view out of a scenic window.

Additionally, conventional shutters employ what is commonly referred to as panels that are hingedly coupled to a frame. There are four panels that surround the louvers of the shutters, the panels forming a type of door-like structure. The louvers are rotated by use of a louver bar coupled to the outside of the louvers, the louver bar allowing a user to grasp the louver bar and move it vertically to change the angle the of the louvers in order to provide various points of opening of the louvers. For egress, the panels are hinged on one side and a user can rotate the panels away from the window for reasons that require access to the window.

These conventional shutters have limitations. The panels are required to retain the louvers and to provide egress to the window. Further, the installation of conventional shutters is a task that requires professional installation, particularly since the dimensions of windows are not exact, making it difficult to self install shutters. The installation requires pre-measurement of all dimensions of windows to be treated and then custom manufacture of the shutters for the windows. This increases the cost of manufacture dramatically and further increases the time it take to install the shutters.

Accordingly, there is a need in the window treatment field for a panelless shutter.

DISCLOSURE OF THE INVENTION

The present invention relates to a panelless shutter having a window frame and including louvers coupled on its ends to louver mechanisms for rotating the louvers. The louvers may also be lifted to provide egress.

An aspect of the present invention includes a panelless shutter comprising a window frame; a louver mechanism coupled to each of a left portion and a right portion of the window frame, wherein each louver mechanism is visually covered by the window frame; a plurality of louvers horizontally mounted within the window frame in a parallel configuration, wherein each end of each louver is coupled to one of the louver mechanisms; and a shutter control member operably coupled to the louver mechanism below the plurality of louvers, the shutter control member including a slideable actuator, wherein the plurality of louvers rotate in response to sliding the actuator.

Another aspect of the present invention includes a panelless shutter comprising a window frame, a center post coupled to the window frame at a center of the window frame; a first shutter portion and a second shutter portion. The first shutter portion comprises: a louver mechanism coupled to each of a left portion of the window frame and the center post, wherein each louver mechanism is visually covered by the window frame and the center post; a first set of louvers horizontally mounted within the window frame in a parallel configuration, wherein each end of each louver is coupled to one of the louver mechanisms; and a shutter control member operably coupled to the louver mechanism below the plurality of louvers, the shutter control member including a slideable actuator, wherein the plurality of louvers rotate in response to sliding the actuator. The second shutter portion comprises a louver mechanism coupled to each of a right portion of the window frame and the center post, wherein each louver mechanism is visually covered by the window frame and the center post; a second set of louvers horizontally mounted within the window frame in a parallel configuration, wherein each end of each louver is coupled to one of the louver mechanisms; and a shutter control member operably coupled to the louver mechanism below the plurality of louvers, the shutter control member including a slideable actuator, wherein the plurality of louvers rotate in response to sliding the actuator. The first and second shutter portions operate independently.

Another aspect of the present invention includes a method of installing a panelless shutter, the method comprising purchasing a panelless shutter off the shelf from one of a do-it-yourself store and ready-to-assemble store; and installing the panelless shutter in a position to cover a window of a house.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a panelless shutter having a frame. Embodiments of the panelless shutter include louvers coupled on its ends to louver mechanisms for rotating the louvers. The louvers may also be lifted to provide egress.

Figure 1:
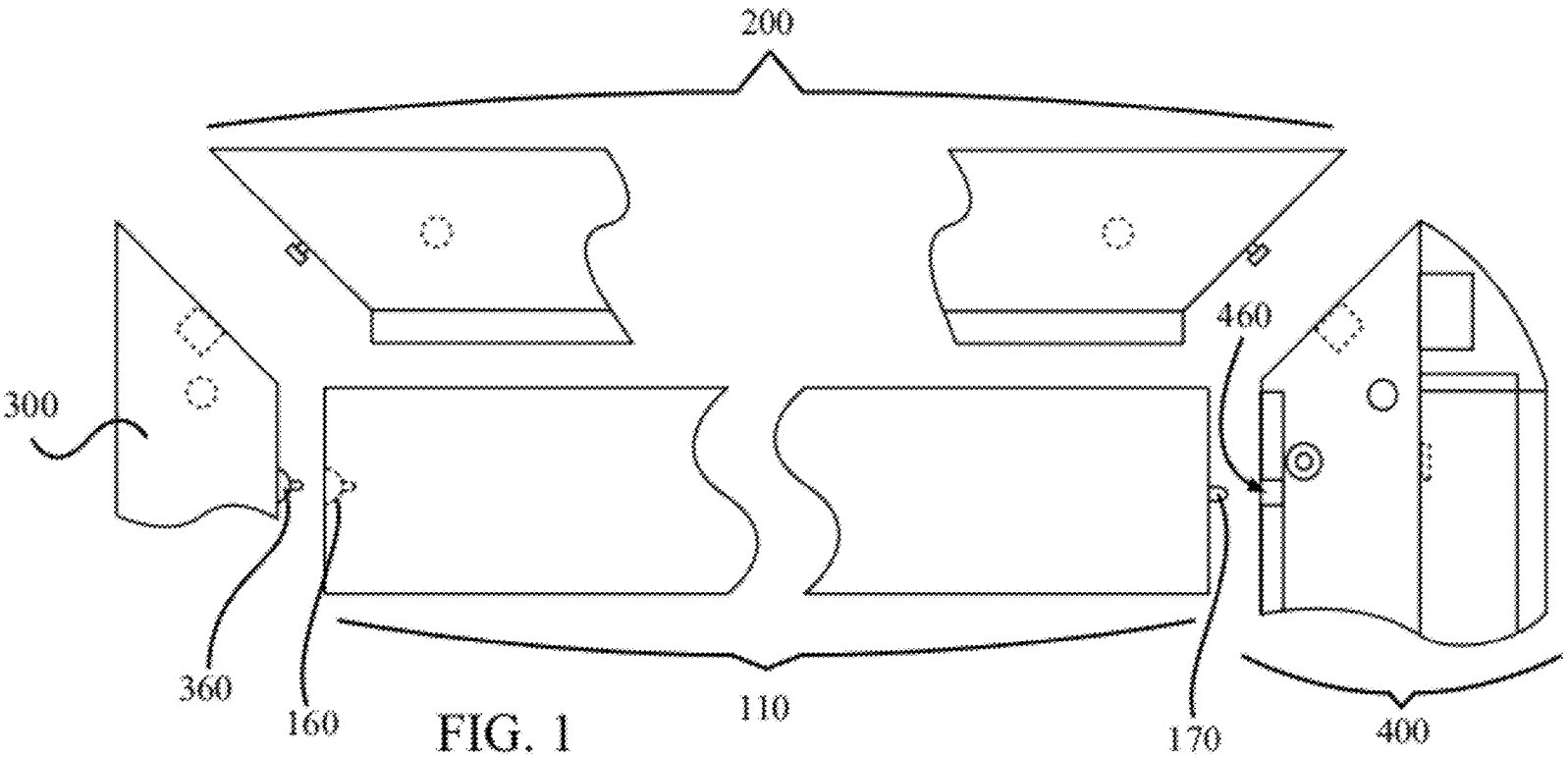
FIG. 1 is an exploded view of a particular panelless shutter according to an embodiment of the present invention.

A panelless shutter of the present invention is shown in use with a hinged face mount frame in FIG. 1. The louver mechanism is hidden by left-side frame portion 300, wherein the louver mechanism has a rotating coupler 360. Above the louver 110, is the top frame portion 200. There is also the right-side frame portion in an opened position to show the louver retainer 410 with louver retaining slots 460. Each louver 110 has a rotating coupler cavity 160 configured to receive the rotating coupler 360 and a retainer protrusion 170 configured to fit within the retaining slot 460. The rotating couplers 360 and the retaining slots are aligned to hold the louver 110 in a substantially horizontal position. This position is maintained for each louver of the plurality of louvers 110 required to properly cover a window, thereby keeping each louver substantially parallel to the other louvers. It will be understood by those of ordinary skill in the art that while the frame in use with the panelless shutter is a hinged face mount frame, any frame type may be used, whether the frame hides or reveals the louver mechanism and/or the louver retainer.

Figure 3:
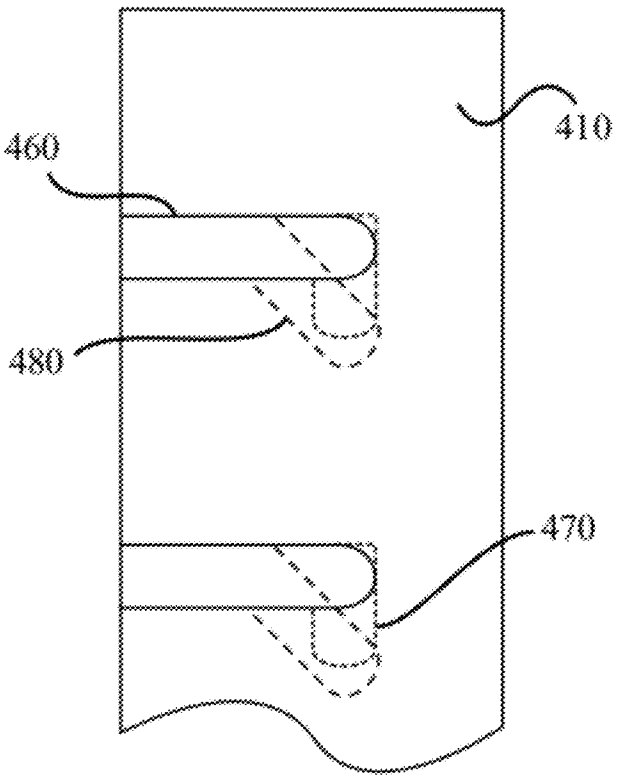
FIG. 3 is a side view of a louver retainer.
Figure 2:
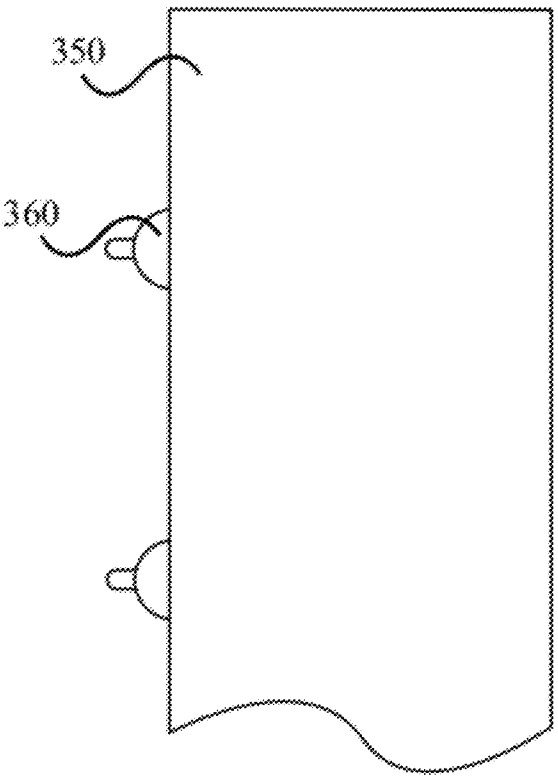
FIG. 2 is a side view of a louver mechanism.

Looking at FIGS. 2-3, particular embodiments of the present invention have louver mechanisms 350 with rotating couplers 360, wherein the rotating couplers 360 simultaneous rotate when a single rotating coupler 360 is rotated. This enables a person to rotate all the louvers 110 connected to the louver mechanism 350 by rotating a single louver 110. Additionally, louver retainer 410 may have retaining slots 460, which are configured to hold the louvers 110 in a position wherein the louvers 110 are freely rotatable. The retaining slots may have alternative configurations to better hold the louvers in a proper functioning position. These alternatives include, but are not limited to, L-shaped slots 470 for retaining the louvers and reducing the ability to apply force laterally to remove the louver and an angled slot 480 allowing the louvers to not remove easily with direct lateral force, but still providing an easier way to remove the louvers to access the window for cleaning or egress. It should be appreciated that while the louver retainer 410 is shown with slots 460, the slots may be holes that do not allow the removal of the louvers with any lateral or vertical force. In particular embodiments, the louvers that are coupled to both the louver mechanism 350 and the louver retainer 410, the entire assembly of louvers, louver mechanism 350 and louver retainer 410 are removable, rotatable, or any other form of moving or removing the entire assembly away from the window to provide access to the window for cleaning or for egress. It will be understood that while particular embodiments have an assembly that allows the removal or rotation away from the window, that yet still other embodiments may use a tool or mechanism for removing a substantial portion of the louvers from the louver retainer 410 at substantially the same time. The tool or mechanism may be removably attached to a substantial portion of plurality of louvers 110. The tool may also be configured such that applying a force on the tool in one particular direction will translate into applying a smaller force to each of the louvers attached to the tool in the same direction, allowing the removal of the substantial portion of the plurality of louvers 110.

It will be understood by those of ordinary skill in the art that particular embodiments of panelless shutters use a louver retainer with slots, other embodiments may use a louver retainer that has shaft protrusions. In such embodiments, the louvers would have apertures sized and shaped to received the shaft protrusions and render the louvers rotatable. Additionally, the louver mechanism may have recesses to receive a protrusion extending from the louvers and enable rotation of all louvers by the rotation of a single louver. It will be understood that the mechanism may be of type that enables the rotation of all of a plurality of louvers by rotating any of the plurality of louvers. These mechanisms may include, but are limited to, racks and pinions, worm gears, drive shafts and any other gear or gear system type that allows the rotation of one louver to translate to the rotation of all louver coupled to the same gear or gear system. It will be known in the art that the louver retainer may be formed of materials such as, but not limited to wood including, but not limited to, basswood, oak, maple, cherry, and hardwoods of various types; plastics and other types of polymers including, but not limited to, acetals, polyethylene, and thermoplastics; polywood; poly-satin compounds; metals including, but not limited to, steel, iron, aluminum, and any other type of metal; and any combination of materials, such as, but not limited to, a wood retainer with a plastic insert in the slot, or any other material combination type. Additionally, the louver mechanism, including the gears, may be formed of any material such as, but not limited to wood including, but not limited to, basswood, oak, maple, cherry, and woods of various types; plastics and other types of polymers including, but not limited to, acetals, polyethylene, and thermoplastics; polywood; poly-satin compounds; metals including, but not limited to, steel, iron, aluminum, and any other type of metal; and any combination of materials, such as, but not limited to, a plastic rack and pinion covered by an aluminum casing.

Figure 4:
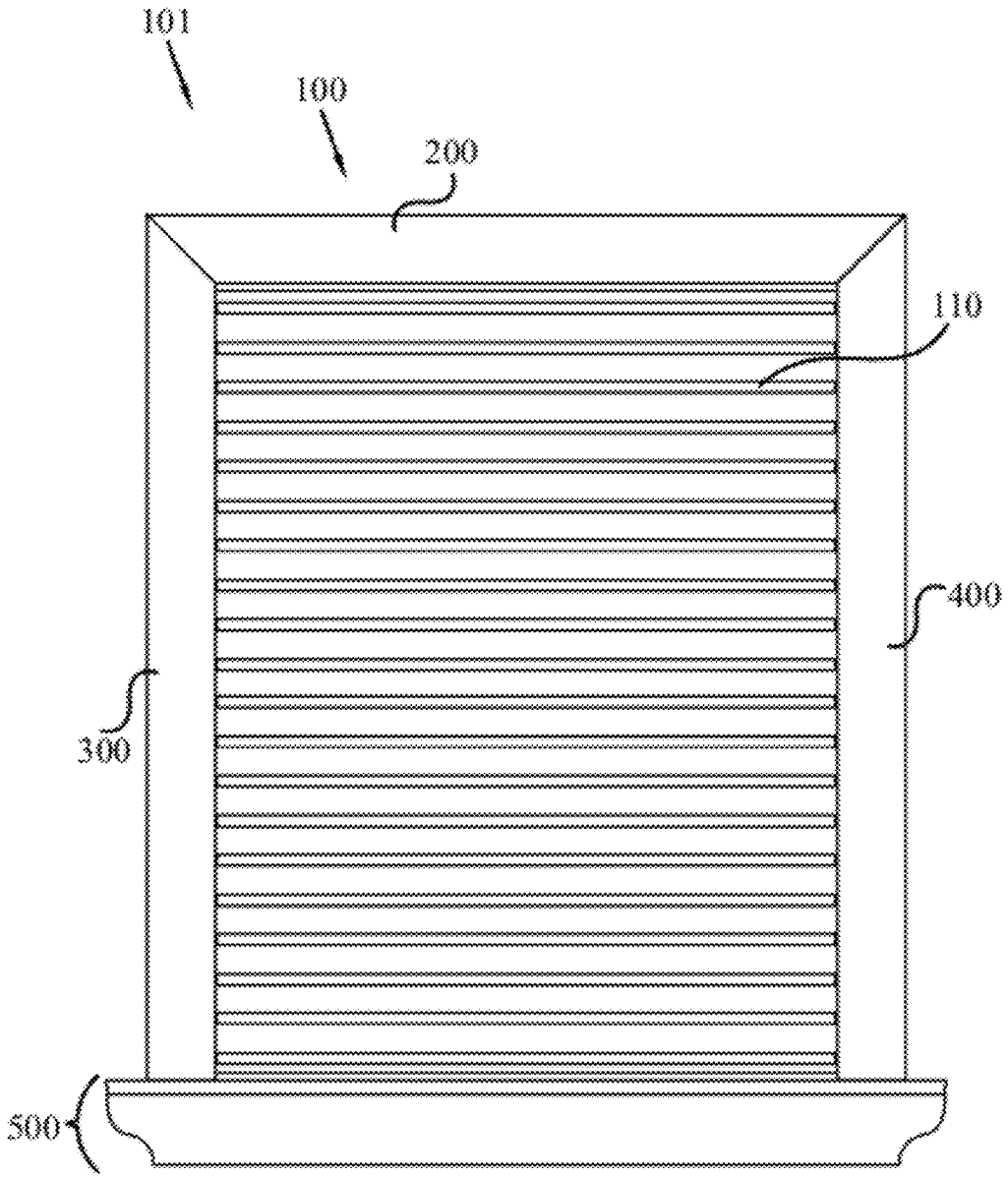
FIG. 4 is a front view of the panelless shutter of FIG. 1 having the louvers in an opened position.
Figure 5:
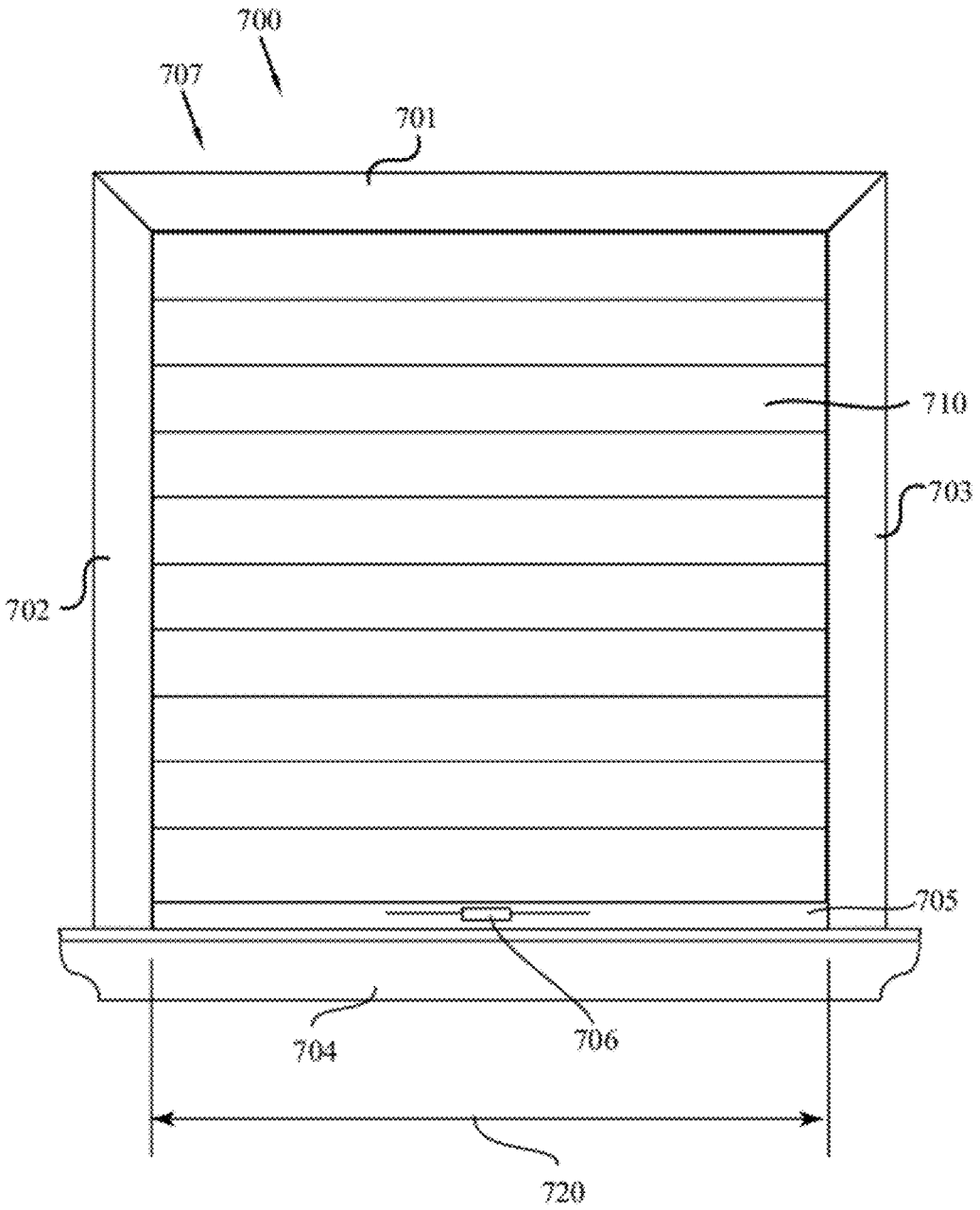
FIG. 5 is a front view of a panelless shutter with louvers in a closed position.
Figure 6:
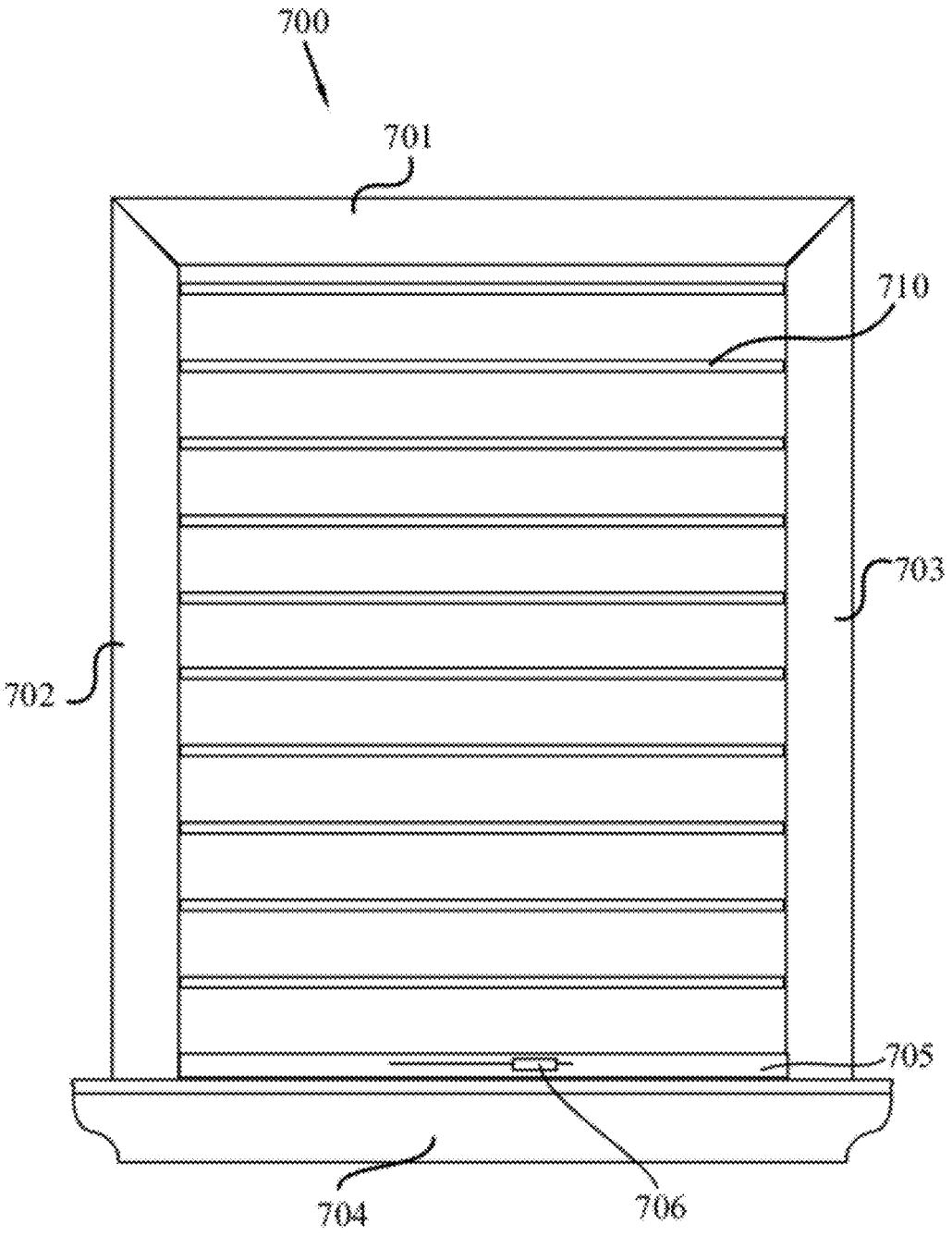
FIG. 6 is a front view of the panelless shutter of FIG. 5 with louvers in an opened position.
Figure 7:
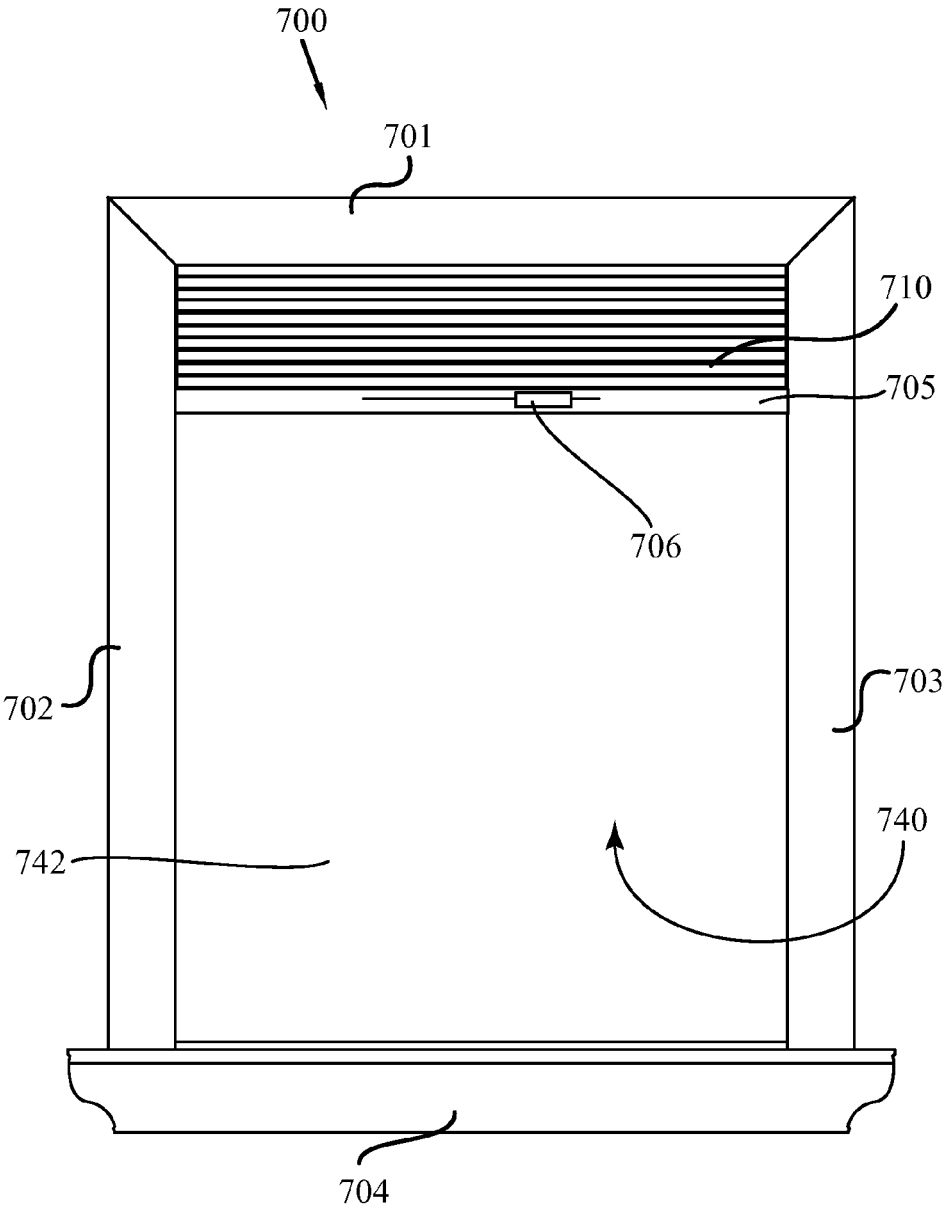
FIG. 7 is a front view of the panelless shutter of FIG. 5 with louvers in a lifted position for egress.
Figure 8:
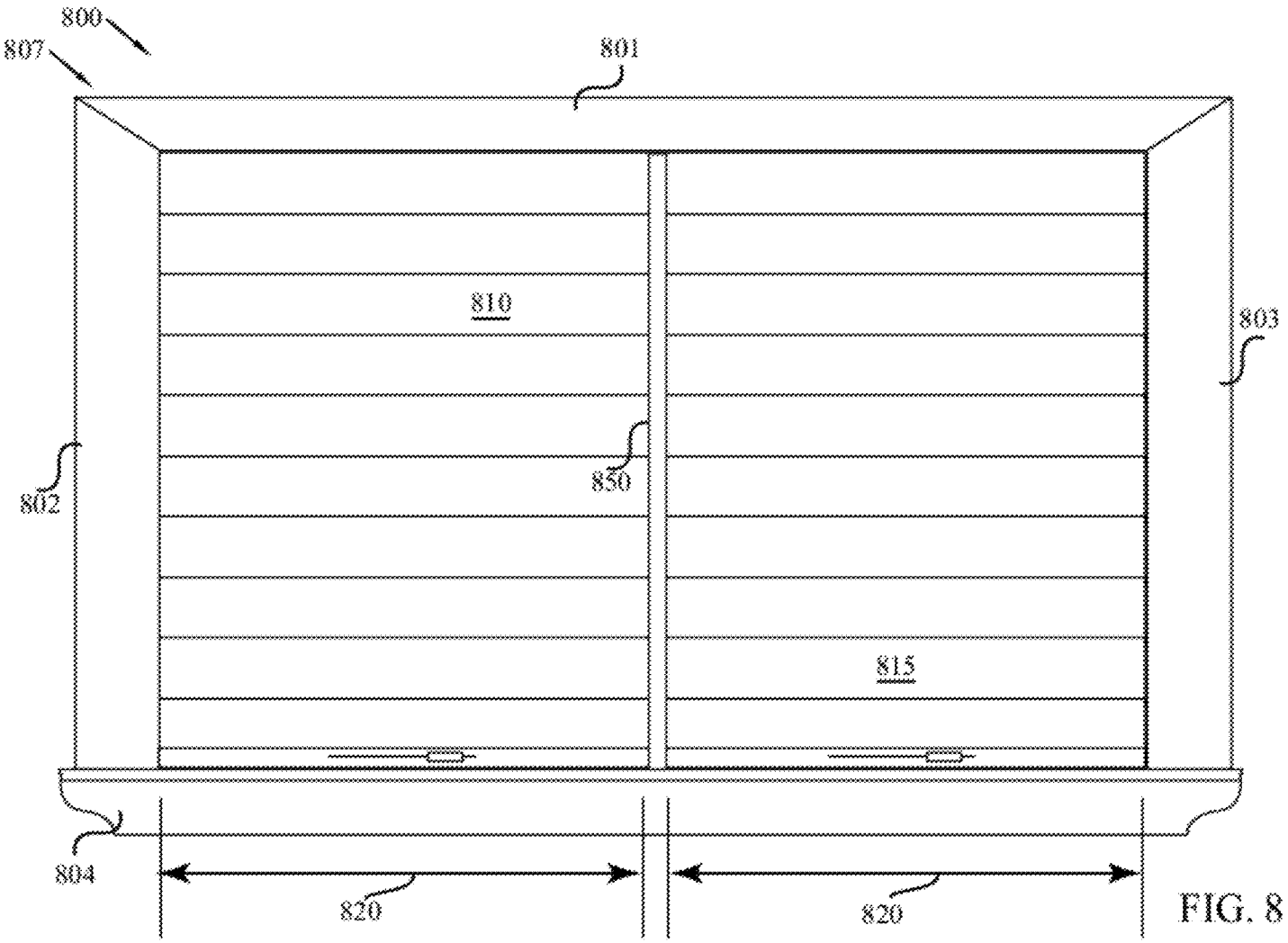
FIG. 8 is a front view of a panelless shutter with a center post having louvers in a closed position.
Figure 9:
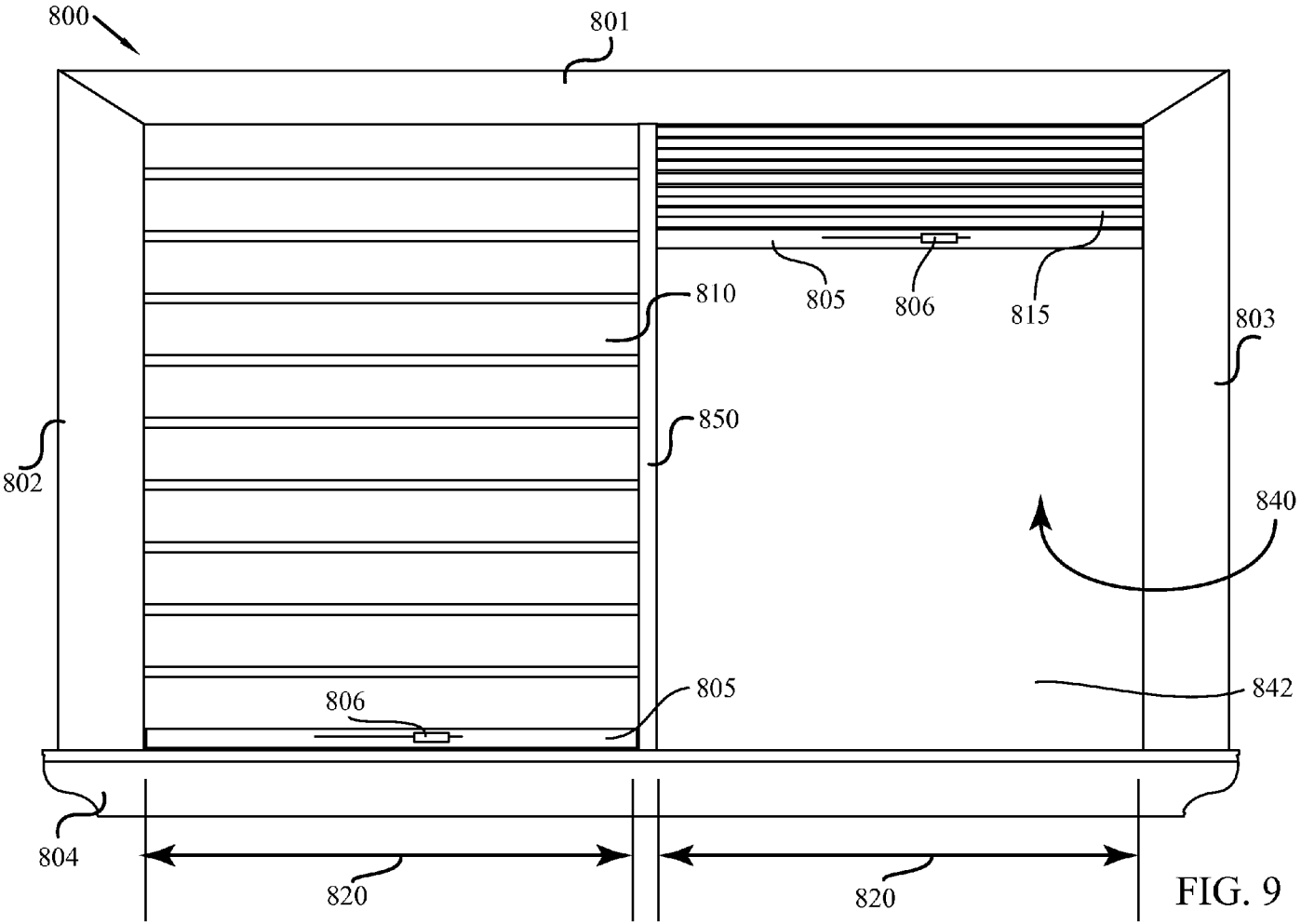
FIG. 9 is a front view of a panelless shutter with a center post with one group of louvers in an opened position and the other group of louvers in a lifted position for egress.
Figure 10A:
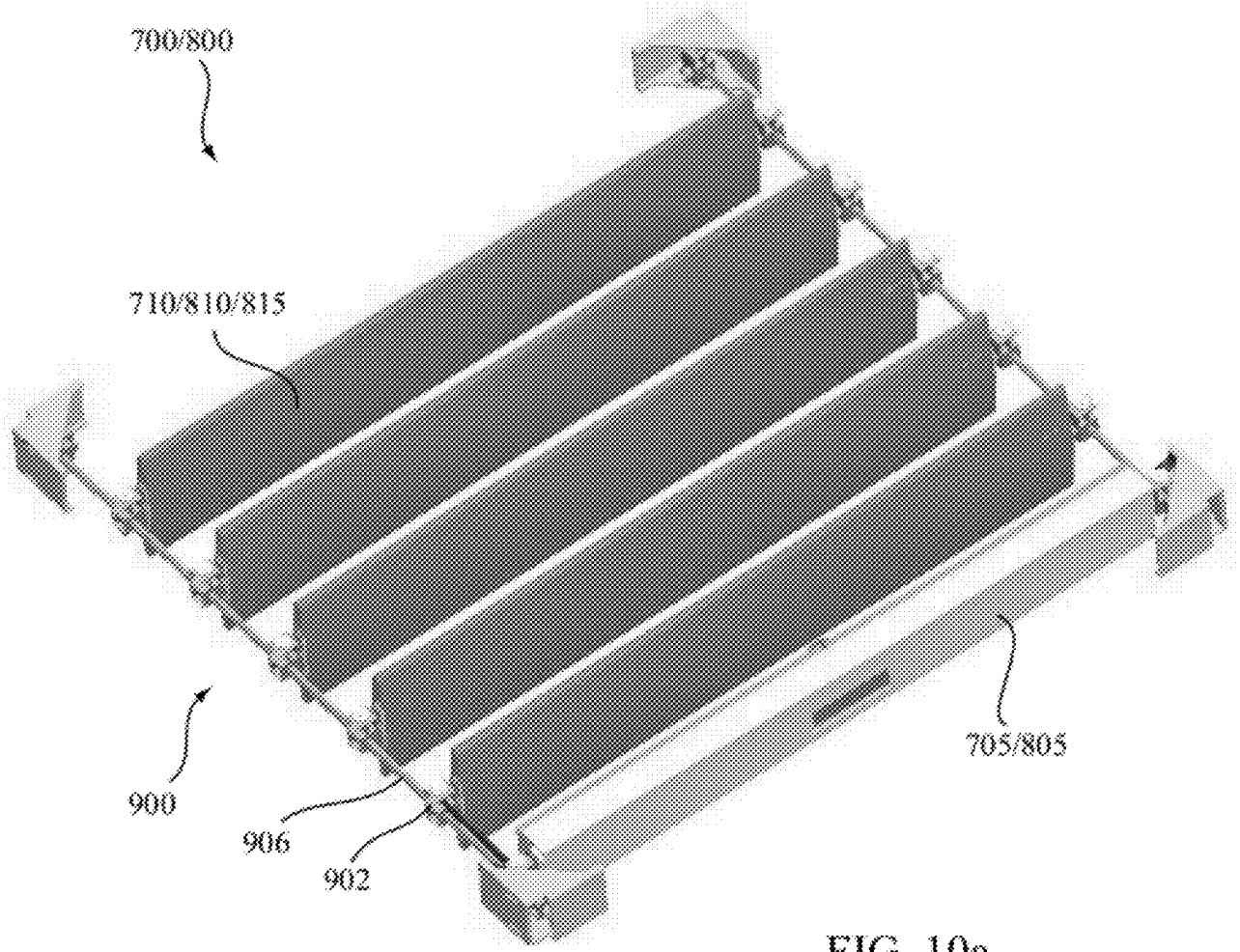
FIG. 10*a* is a perspective view of a panelless shutter with out the frame showing the louver mechanism.
Figure 10B:
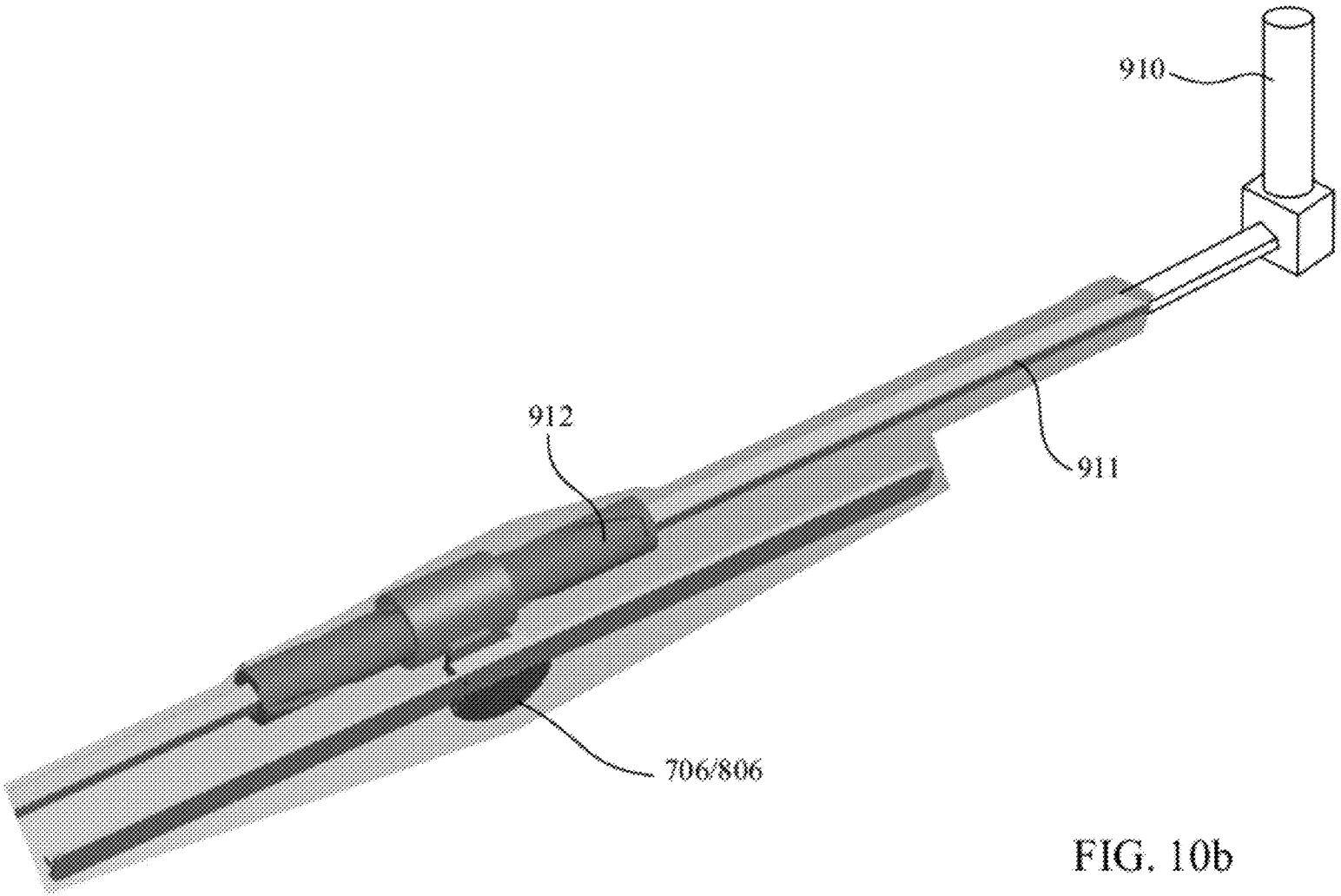
FIG. 10*b* is a perspective view of an actuator of a shutter control member.
Figure 10C:
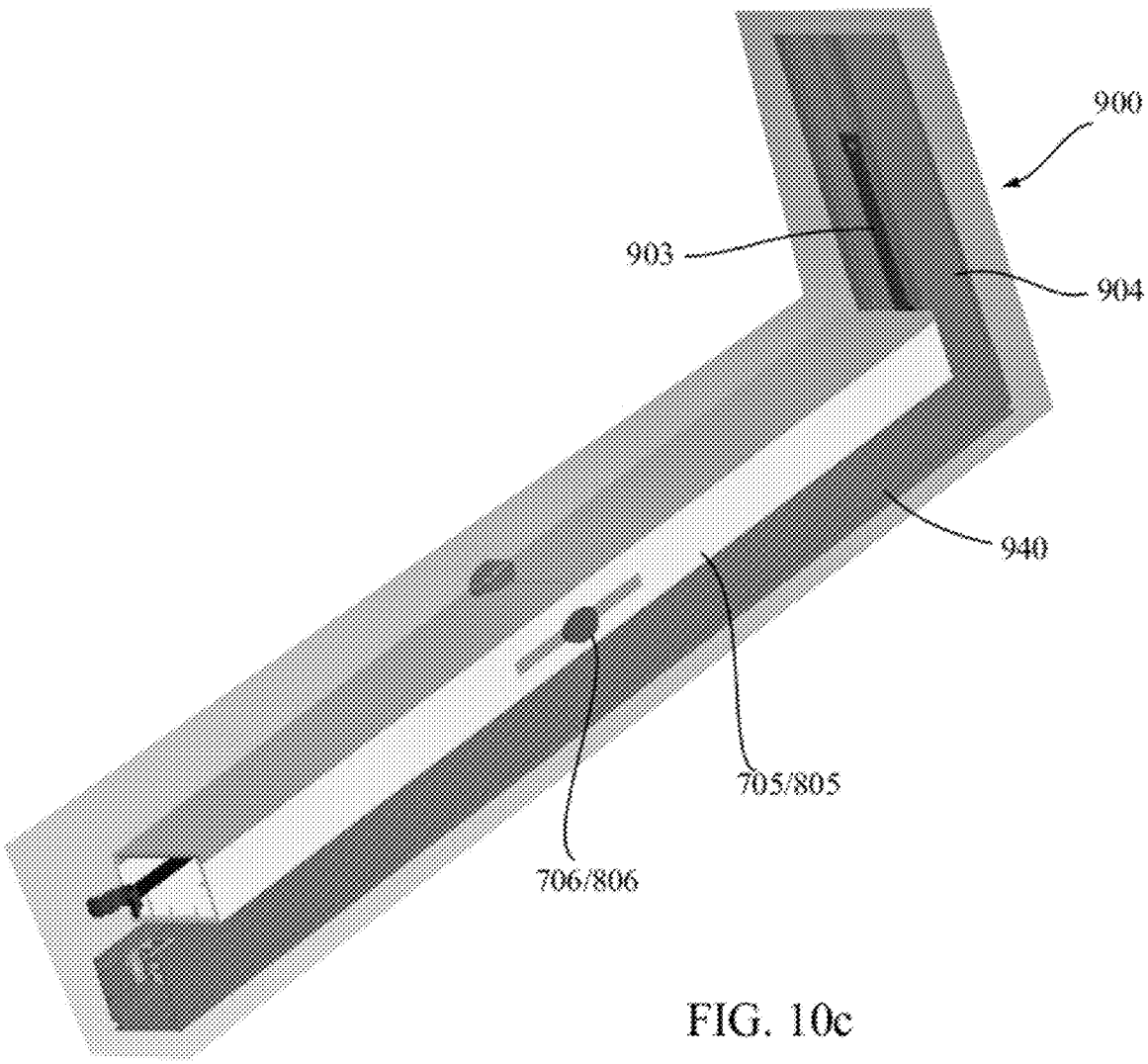
FIG. 10*c* is a perspective view of a shutter control member couples to a louver mechanism.
Figure 11:
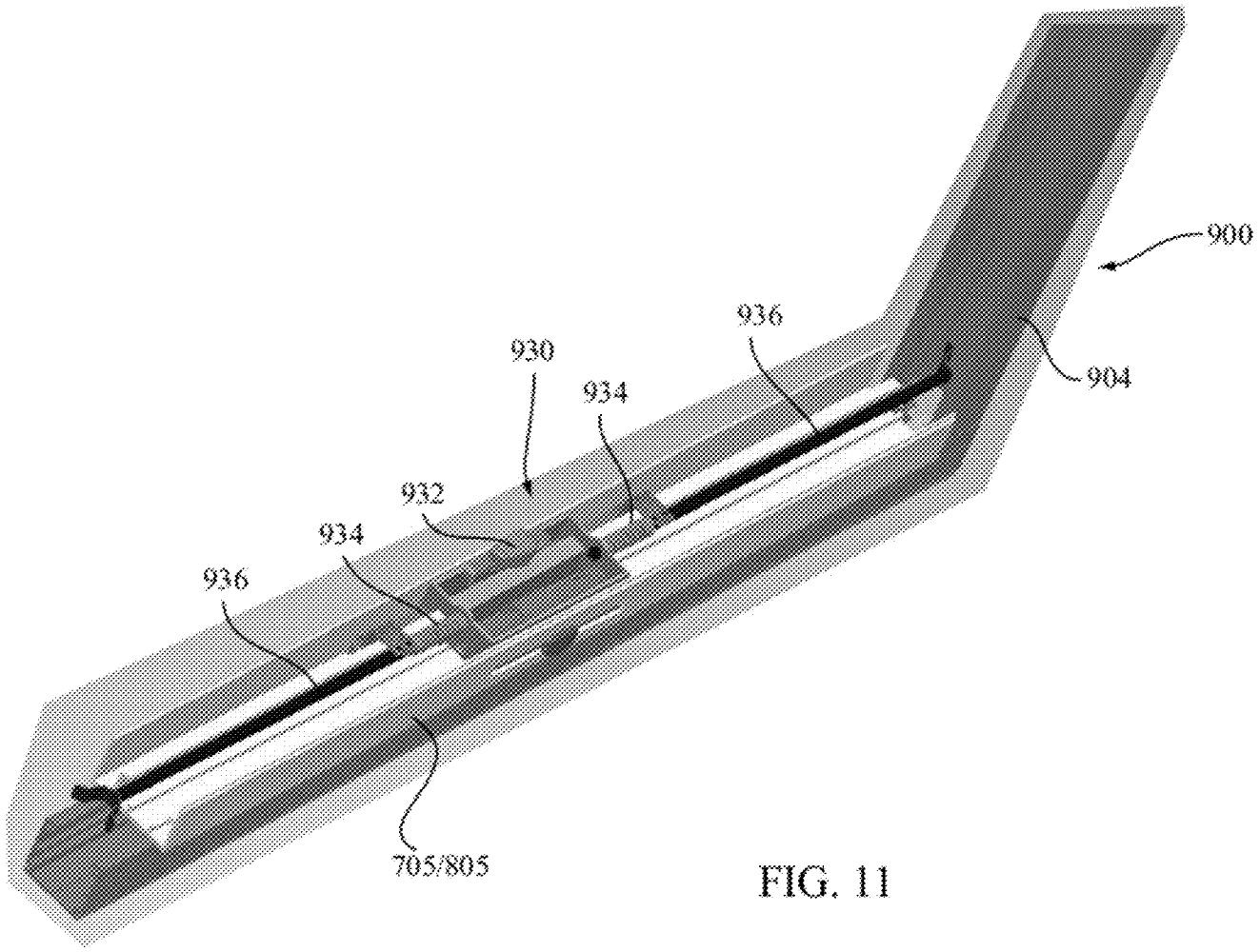
FIG. 11 is a perspective view of a locking mechanism of a shutter control member.
Figure 12:
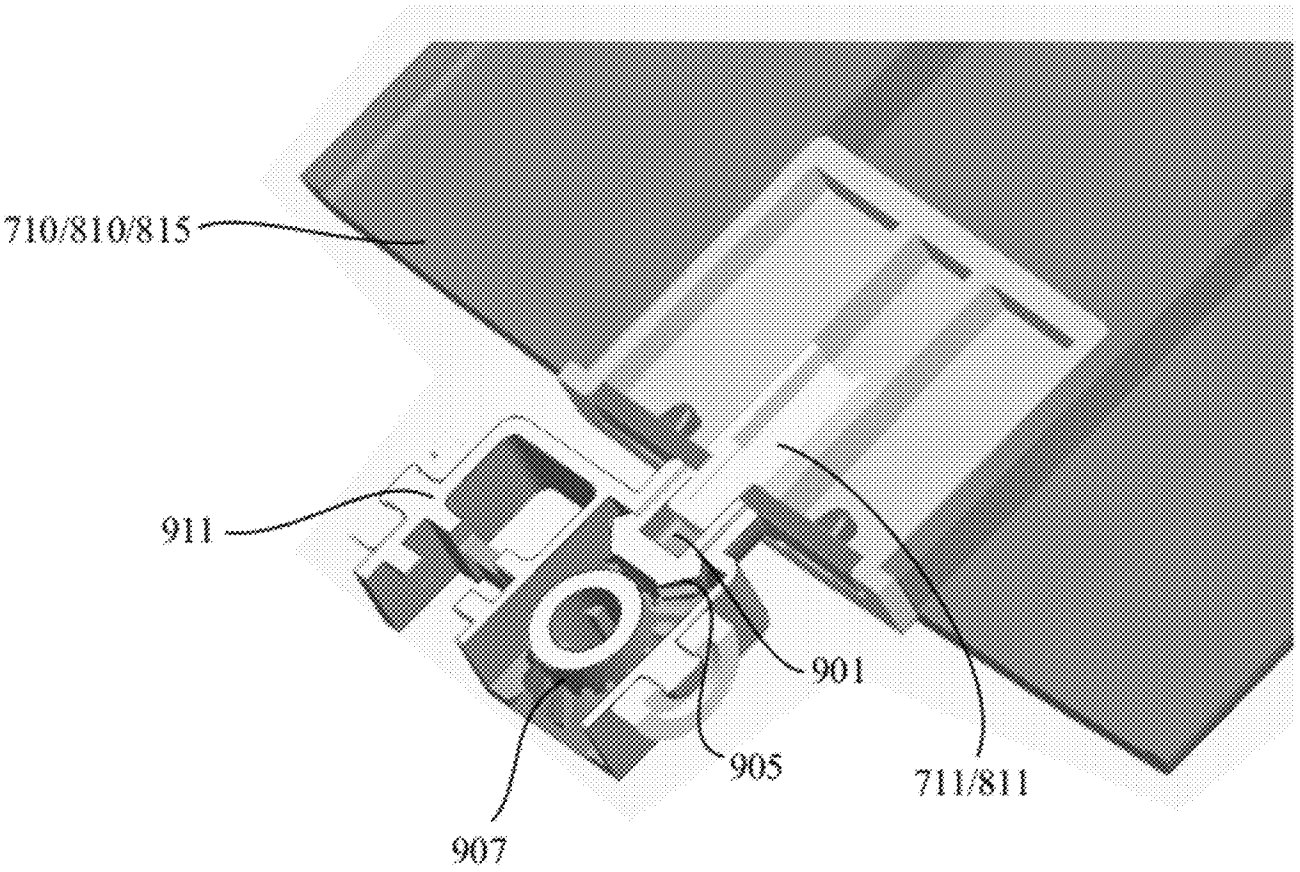
FIG. 12 is a perspective view of louver coupled to a carrier in accordance with the present invention.

FIG. 4 shows a front view of a panelless shutter 101 with a window frame 100, wherein the louvers 110 are rotated in an opened position. The window frame 100 comprises top frame portion 200, left-side frame portion 300, right-side frame portion 400 and bottom frame portion 500. In particular embodiments, each frame portion as well as the louvers may be formed of wood and painted, stained or coated to achieve a desired look. In other embodiments, the frame portions and louvers may be formed of materials such as, but not limited to, wood including, but not limited to, basswood, oak, maple, cherry, and woods of various types; plastic and other types of polymers including, but not limited to, acetals, polyethylene, and thermoplastics; medium density fiberboard ("MDF") that is painted; MDF that is plastic coated; polywood; poly-satin compounds; metals including, but not limited to, steel, iron, aluminum, and any other type of metal; and any other material or combination of materials wherein the present invention may still be functional and durable to withstand rotation of the louvers, removal of the louvers and to withstand the normal forces applied to the hinged face mount frame and the panelless shutter while in use.

Referring again to the drawings, FIGS. 5-7 and 10-12 depict another embodiment of a panelless shutter 700 in accordance with particular embodiments of the present invention. The panelless shutter 700 comprises a window frame 707 with a top portion 701, a left side portion 702 a right side portion 703 and a bottom portion 704. The window frame portions 701-704 are mounted adjacent a window. The shutter 700 further comprises a plurality of louvers 710, a louver mechanism 900 coupled to each the left portion 702 and the right portion 703 of the window frame 707, and a shutter control member 705.

The plurality of louvers 710 are horizontally mounted within the window frame 707 in a parallel configuration, each end of each louver 710 is coupled to one of the louver mechanisms 900. The shutter control member 705 is operably coupled to each louver mechanism 900 below the plurality of louvers 710. The shutter control member 705 includes a slideable actuator 706, wherein the plurality of louvers 710 rotate in response to sliding the actuator 706.

The louver mechanism 900 comprises a plurality of carriers 902 slideably mounted within a track 904 and a mechanism shaft 906 extending through each of the plurality of carriers 902. The plurality of carriers 902 rotate the plurality of louvers 710 in response to the rotation of the mechanism shaft 906 of the louver mechanism 900. The carrier 902 includes a recess 901 for receiving a spring biased pin 711 of the louver 710. The spring biased pin 711 can retract and then insert within the recess 901. The recess is integral with a louver gear portion 905 that engages a carrier gear 907. The carrier gear is operatively coupled to the mechanism shaft 910, wherein the rotation of the mechanism shaft 910 rotates the carrier gear 907, which in turn rotates the louver gear 905 and thereby rotates the louver 710.

The shutter control member 705 further comprises an actuator shaft 911. The actuator 706 engages the mechanism shaft 906 of the louver mechanism 900 with an actuator shaft 911, wherein the actuator shaft 911 rotates in response to sliding of the actuator 706 and the mechanism shaft 906 rotates in response to the rotation of the actuator shaft 911. In particular embodiments, the actuator shaft 911 may include a threaded portion 912, wherein the actuator 706 is operatively coupled to the threaded portion 912. Accordingly, when the actuator 706 is slid in a particular direction, the threaded engagement with the threaded portion causes the actuator shaft 911 to rotate.

The shutter control member 705 also comprises a locking mechanism 930, wherein the locking mechanism includes a lock actuator 932, springs 934 and lock rods 936. The lock rods 936 extend and engage the louver mechanisms 900 on each side of the shutter control member 705. The springs 934 bias the lock rods 936 in a locking engagement with the louver mechanisms 900. In order to lift the shutter control member along the track 904, the lock actuator 932 must be depressed to disengage the lock rods 936 from the louver mechanism 900. In this condition of disengaged lock rods, 936, the louvers 710 lift in response to lifting of the shutter control member 705. The locking mechanism 930 may be utilized to lock the shutter control member 705 at various heights along the track 904. In the lifted position, an opening 740 is created for egress or to access window 742.

The louver mechanism 900 includes spacing members 903 coupled to each carrier 902 that determine the space between each carrier 902 by hanging from the adjacent carrier 902 above each carrier 902, the spacing members 903 being collapsible when the plurality of louvers 710 are lifted. The louvers 710 may then be lowered in response to lowering of the shutter control member 705, wherein each of the plurality of louvers 710 are substantially parallel and spaced apart from adjacent louvers 710 at a distance determined by the spacing members 903.

Referring again to the drawings, FIGS. 8-12 depict a panelless shutter 800 in accordance with particular embodiments of the present invention. The panelless shutter 800 comprises a window frame 807 with a top portion 801, a left side portion 802 a right side portion 803 and a bottom portion 804. The window frame portions 801-804 are mounted adjacent a window. The shutter 800 further comprises a first shutter portion having a first set of louvers 810 and a second shutter portion having a second set of louvers 815 separated by a center post 850. For each set of louvers 810 and 815, the panelless shutter 800 further include two louver mechanisms 900 and a shutter control member 805. For the first set of louvers 810, one louver mechanism is coupled to the left portion 802 and the other louver mechanism 900 is coupled to the center post 850. For the second set of louvers 815, one louver mechanism 900 is coupled to the right portion 803 and the other louver mechanism 900 is coupled to the center post. The first and second shutter portions operate independently Each set of louvers 810 and 815 are horizontally mounted within the window frame 807 in a parallel configuration, each end of each louver 810 or 815 is coupled to one of the corresponding louver mechanisms 900. Each shutter control member 805 is operably coupled to each corresponding louver mechanism 900 below the corresponding set of louvers 810 or 815. Each shutter control member 805 includes a slideable actuator 806, wherein the corresponding set of louvers 810 or 815 rotate in response to sliding the actuator 806.

Each louver mechanism 900 comprises a plurality of carriers 902 slideably mounted within a track 904 and a mechanism shaft 906 extending through each of the plurality of carriers 902. The plurality of carriers 902 rotate the plurality of louvers 710 in response to the rotation of the mechanism shaft 906 of the louver mechanism 900. The carrier 902 includes a recess 901 for receiving a spring biased pin 811 of the louver 810 and 815. The spring biased pin 811 can retract and then insert within the recess 901. The recess is integral with a louver gear portion 905 that engages a carrier gear 907. The carrier gear is operatively coupled to the mechanism shaft 910, wherein the rotation of the mechanism shaft 910 rotates the carrier gear 907, which in turn rotates the louver gear 905 and thereby rotates the louver 810 and 815.

Each shutter control member 805 further comprises an actuator shaft 911. The actuator 806 engages the mechanism shaft 906 of the louver mechanism 900 with an actuator shaft 911, wherein the actuator shaft 911 rotates in response to sliding of the actuator 806 and the mechanism shaft 906 rotates in response to the rotation of the actuator shaft 911. In particular embodiments, the actuator shaft 911 may include a threaded portion 912, wherein the actuator 806 is operatively coupled to the threaded portion 912. Accordingly, when the actuator 806 is slid in a particular direction, the threaded engagement with the threaded portion causes the actuator shaft 911 to rotate.

Each shutter control member 805 also comprises a locking mechanism 930, wherein the locking mechanism includes a lock actuator 932, springs 934 and lock rods 936. The lock rods 936 extend and engage the louver mechanisms 900 on each side of the shutter control member 805. The springs 934 bias the lock rods 936 in a locking engagement with the louver mechanisms 900. In order to lift the shutter control member along the track 904, the lock actuator 932 must be depressed to disengage the lock rods 936 from the louver mechanism 900. In this condition of disengaged lock rods, 936, the louvers 810 and 815 lift in response to lifting of the corresponding shutter control member 805. The locking mechanism 930 may be utilized to lock the shutter control member 805 at various heights along the track 904. In the lifted position, an opening 40 is created for egress or to access window 842.

Each louver mechanism 900 includes spacing members 903 coupled to each carrier 902 that determine the space between each carrier 902, the spacing members 903 being collapsible when the plurality of louvers 810 and 815 are lifted. The louvers 810 and 815 may then be lowered in response to lowering of the corresponding shutter control member 805, wherein each of the plurality of louvers 710 are substantially parallel and spaced apart from adjacent louvers 810 and 815 respectively at a distance determined by the spacing members 903.

In particular embodiments of the present invention, it is contemplated that a plurality of shutter portions may be utilized with one single panelless shutter. This is particularly useful for windows that have a significant length.

The louver mechanisms 900 may be supported by horizontal supports 940. The horizontal supports may be visually covered by the top portion 701/801 and the bottom portion 704/804 of the window frame 707/807. The panelless shutters 700 and 800 may each be mounted on the face of a window opening or inside a window opening. The respective window frames 707 and 807 may then be used to cover the louver mechanisms 900, horizontal supports 940 and any gaps between the wall and the louver mechanisms 900 and the wall and the horizontal supports 940.

Another embodiment of the present invention includes a method of installing a panelless shutter. The method includes purchasing a panelless shutter off the shelf from one of a do-it-yourself store and ready-to-assemble store; and installing the panelless shutter in a position to cover a window of a house. The method may further include mounting louver mechanisms adjacent the window; mounting a plurality of louvers within the louver mechanism and coupling a window frame over the louver mechanisms and horizontal supports.

The embodiments and examples set forth herein were presented in order to best explain the present invention and its practical application, and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A panelless shutter comprising:

a window frame;

a plurality of louvers horizontally mounted within the window frame in a substantially parallel configuration, wherein each end of each louver is rotatably coupled to a carrier and each louver is rotatable with respect to the carrier and the plurality of louvers are lifted and lowered along the window frame; and spacing members coupled to each carrier, the spacing members determining the space between each louver, the spacing members being collapsible when the plurality of louvers are lifted, wherein each carrier is slideably mounted within a track; and a shutter control member, wherein the louvers lift and lower in response to lifting and lowering the shutter control member along the track, and wherein all of the louvers of the plurality of louvers are lifted in response to lifting the shutter control member along the track to place the uppermost louver in contact with a top portion of the window frame.

2. The shutter of claim 1, wherein all louvers rotate in response to rotation of one louver.

3. A panelless shutter comprising:

a window frame;

a center post coupled to the window frame at a center of the window frame;

a first shutter portion comprising:

a first set of louvers horizontally mounted within the window frame between a left portion of the window frame and the center post in a substantially parallel configuration, wherein each end of each louver of the first set of louvers is rotatably coupled to a first carrier and each louver is rotatable with respect to the first carrier and the plurality of louvers are lifted and lowered along the window frame;

first spacing members coupled to each first carrier, the first spacing members determining the space between each louver of the first set of louvers, the first spacing members being collapsible when the first set of louvers are lifted, wherein each first carrier is slideably mounted within a first track; and a first shutter control member, wherein the first set of louvers lift and lower in response to lifting and lowering the first shutter control member along the first track, wherein all of the louvers of the first set of louvers are lifted in response to lifting the first shutter control member along the first track to place the uppermost louver of the first set of louvers in contact with a top portion of the window frame; and a second shutter portion comprising:

a second set of louvers horizontally mounted within the window frame between a right portion of the window frame and the center post in a substantially parallel configuration, wherein each end of each louver of the second set of louvers is rotatably coupled to a second carrier and each louver of the second set of louvers is rotatable with respect to the second carrier and the second set of louvers are lifted and lowered along the window frame;

second spacing members coupled to each second carrier, the second spacing members determining the space between each louver of the second set of louvers, the second spacing members being collapsible when the second set of louvers are lifted, wherein each second carrier is slideably mounted within a second track; and a second shutter control member, wherein the second set of louvers lift and lower in response to lifting and lowering the second shutter control member along the second track; wherein all of the louvers of the second set of louvers are lifted in response to lifting the second shutter control member along the second track to place the uppermost louver of the second set of louvers in contact with a top portion of the window frame, and wherein the first and second shutter portions operate independently.

4. The shutter of claim 3, wherein all louvers rotate in response to rotation of one louver.

5. The shutter of claim 1, wherein the shutter control member comprises a locking mechanism for locking the shutter control member at various heights along the track.

6. The shutter of claim 4, wherein the shutter control member of the first and the second shutter portions each comprises a locking mechanism for locking the shutter control member at various heights along the track.

7. A panelless shutter comprising:

a window frame;

a plurality of louvers horizontally mounted within the window frame in a substantially parallel configuration, wherein each end of each louver is rotatably coupled to a carrier and each louver is rotatable with respect to the carrier and the plurality of louvers are lifted and lowered along the window frame; and spacing members coupled to each carrier, the spacing members determining the space between each louver, the spacing members being collapsible when the plurality of louvers are lifted, wherein each carrier is slideably mounted within a track; and a shutter control member that is not a louver, wherein the louvers lift and lower in response to lifting and lowering the shutter control member along the track, and wherein all of the louvers of the plurality of louvers are lifted in response to lifting the shutter control member along the track to place the uppermost louver in contact with a top portion of the window frame.

* * * * *